United States Patent [19]

Perret

[11] Patent Number: 4,650,942

[45] Date of Patent: Mar. 17, 1987

[54] COMPRESSED GAS HIGH TENSION CIRCUIT BREAKER, REQUIRING LOW OPERATING ENERGY

[75] Inventor: Michel Perret, Villeurbanne, France

[73] Assignee: Alsthom, Paris, France

[21] Appl. No.: 818,419

[22] Filed: Jan. 13, 1986

[30] Foreign Application Priority Data

Jan. 16, 1985 [FR] France ..... 85 00612

[51] Int. Cl.[4] ..... H01H 33/88

[52] U.S. Cl. ..... 200/148 A; 200/148 R

[58] Field of Search ..... 200/148 A, 148 R

[56] References Cited

U.S. PATENT DOCUMENTS 4,163,131 7/1979 Perkins ..... 200/148 A 4,486,632 12/1984 Niemeyer et al. ..... 200/148 A

FOREIGN PATENT DOCUMENTS 2349205 11/1977 France ..... 200/148 A 2506511 11/1982 France ..... 200/148 A

*Primary Examiner*—Robert S. Macon

*Attorney, Agent, or Firm*—Sughrue, Mion, Zinn Macpeak & Seas

[57] ABSTRACT

The invention relates to a compressed gas high tension circuit breaker requiring low operating energy. The circuit breaker is located in a gas tight enclosure filled with gas having high dielectric power, and comprises a fixed assembly including a main contact and an arcing contact, and a moving assembly including a main contact and an arcing contact. The moving assembly includes a chamber (21) which is delimited by two tubular elements (20, 18A) each of which slides over two tubular surfaces (7, 8) of the fixed assembly, said chamber being in communication with the zone in which the arcing contacts separate via a plurality of holes (18B).

5 Claims, 3 Drawing Figures

COMPRESSED GAS HIGH TENSION CIRCUIT BREAKER, REQUIRING LOW OPERATING ENERGY

The invention relates to a compressed gas high tension circuit breaker requiring low operating energy.

BACKGROUND OF THE INVENTION

The present invention relates, more precisely, to circuit breakers of the type which contain a gas having good dielectric properties, such as sulfur hexafluoride, at a pressure of a few atmospheres.

Further, it relates to puffer type circuit breakers including a chamber in which gas is compressed when the circuit breaker openings and is directed towards the zone where the arcing contacts separate. Further, when interrupting high intensity currents (e.g. short circuits) the arc which is struck between the arcing contacts heats the surrounding gas and increases its pressure.

An air of the present invention is to provide a circuit breaker in which the local pressure increase due to the arc is used to assist in displacing the moving parts of the circuit breaker, thereby reducing the amount of energy required to open the circuit breaker.

Another aim of the invention is to provide a circuit breaker in which the speed at which the moving assembly moves away from the fixed assembly when the circuit breaker is opened increases with increasing intensity of the current to be interrupted.

SUMMARY OF THE INVENTION

The invention provides a compressed gas high tension circuit breaker requiring low operating energy, said circuit breaker comprising a sealed enclosure filled with a gas of high dielectric power, a fixed assembly including a main contact and an arcing contact, and a moving assembly including a main contact and an arcing contact, the circuit breaker including the improvement whereby the moving assembly further includes a chamber which is delimited by two tubular elements each sliding over two tubular surfaces of the fixed assembly, said chamber being put into communication with the zone in wnhich the arcing contacts separate by means of a plurality of holes.

BRIEF DESCRIPTION OF THE DRAWINGS

An embodiment of the invention is described by way of example with reference to the accompanying drawings, in wwhich.

MORE DETAILED DESCRIPTION

Figure 1:
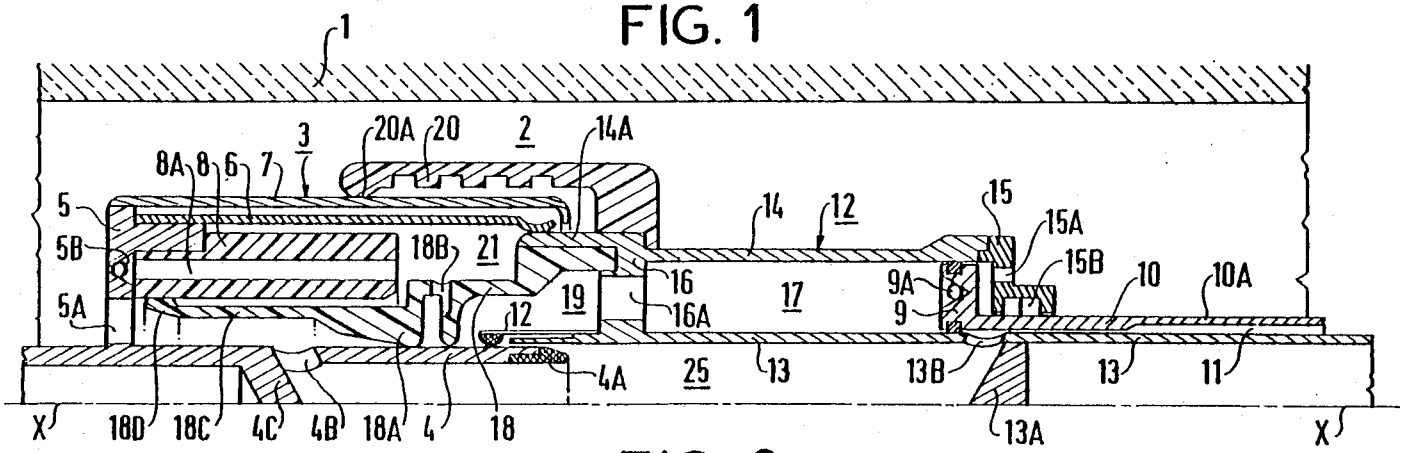
FIG. 1 is a longitudinal axial section through a portion of a circuit breaker in accordance with the invention, shown in the closed position.

The circuit breaker comprises an insulating envelope 1 which is cylindrical about an axis XX, a fixed mechanical assembly 3, and a moving mechanical assembly 12. The envelope is gastight and is filled with a gas having good dielectric properties, e.g. sulfur hexafluoroide, at a pressure of a few atmospheres.

The space lying between the envelope and the mechanical assemblies is referenced 2.

The fixed assembly 3 comprises a metal tube 4 serving as a fixed arcing contact, and terminated by a portion 4A of material which withstands the effects of arcing (e.g. tungsten).

The tube has a plurality of holes such as 4B for allowing the gas to pass at the end of a circuit-breaking operation.

A ring 5 is fixed to the tube 4 (or is integrally machined therewith) and bears contact fingers 6, thereby constituting the main fixed contact of the circuit breaker. The fingers 6 are protected by a discharge-preventing cap 7.

There are holes such as 5A through the ring 5 in order to evacuate hot gas at the end of a circuit-breaking operation.

Finally, the ring carries a thick cylinder 8 of insulating material which, for reasons explained below, is intended to limit the volume of gas in the chamber 21 situated to the righthand side thereof (as shown in the figures).

A duct 8A passes through the cylinder 8 and puts the chamber 21 into communication with the space 2 via a non-return valve 5B through the ring 5. This disposition is used to enable the chamber 21 to be filled when the moving contact is in motion, thereby avoiding a braking effect due to suction. As is explained below, when the pressure increases in the chamber 21 because of the temperature rise to the arc, the valve 5B closes.

The fixed assembly also has a piston 9 of annular section, and a portion rod 10 in the form of a tube having a portion of reduced thickness 10A.

A non-return valve 9A serves to put both sides of the piston into communication with each other, thereby facilitating filling of the chamber 17 located to the left of the piston in the figures when the circuit breaker is engaged.

The moving assembly 12 includes two tubes 13 and 14 which are coaxial with the axis XX.

The tube 13 which is the closer to the axis, has contact fingers 12 disposed in a bell configuration to cooperate with the tube 4.

A disk 13A is fixed to the tube 13, and together with a disk 4C fixed to the tube 4 serves to delimit an axial volume 25.

Holes 13B through the tube 13 allow hot gas to escape when an arc is being extinguished.

The tube 14, together with the tube 13 constitutes a cylinder of annular section within which the piston 9 is slidably mounted.

This cylinder is closed at one end by a ring 15 which is provided with holes 15A for pressure balancing when the circuit breaker is engaged and disengaged. The ring 15 carries electrical contacts 15B which slide over the tube 10 in order to pass the electrical current.

The tube 14 and the tube 13 are connected at the other end of the cylinder by a ring 16 having a nozzle 18 made of insulating material.

The ring 16 has large holes therethrough putting the inside chamber 17 of the cylinder into communication with the volume 19 lying between the contacts 12 and the nozzle 18.

The nozzle has a throat 18A which comes into contact with the tube 4 in order to close the volume 19. The holes 18B provide passages for gas to pass through the nozzle in a generally radial direction for reasons and under circumstances which are described below. Beyond the throat, the nozzle has an elongate portion 18C which is terminated by a flange 180 coming into contact with the cylinder 8.

The tube 14 has a portion 14A situated beyond the ring 16 and serving as the main moving contact.

Finally, the disk 16 has a tubular portion made of insulating material and having an inwardly directed flange 20A at its end which comes into contact with the tube 7. The chamber volume lying between the nozzle 18 and the fingers 6 is referenced 21.

The circuit breaker operates as follows:

When in the closed position, electrical current passes along the tube 4, the ring 5, the fixed main contacts 6, the tube 14, the ring 15, the contacts 15B, and the tube 10.

Interrupting a high intensity (short circuit) currents

The moving assembly connected to an operating member (not shown) moves to the right (as shown in the figures). The main contacts move apart and current then passes solely through the arcing contacts.

Figure 2:
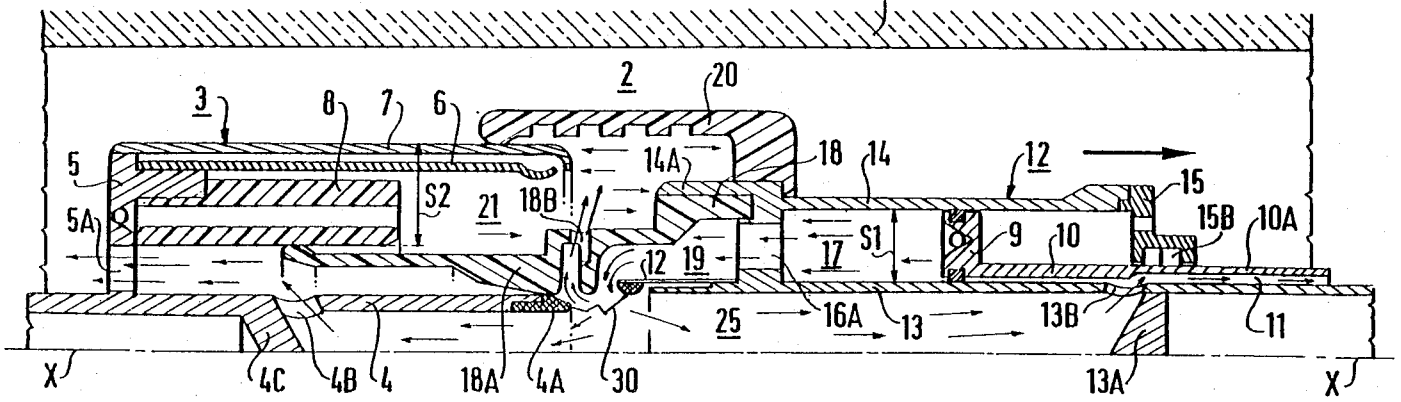
FIG. 2 is a view similar to FIG. 1 showing the same circuit breaker during opening.

When the arcing contacts separate (FIG. 2) an arc 30 is struck therebetween and heats the surrounding gas whose pressure, which has already begun to rise by virtue of the relative displacement of the piston 9 now begins to rise very fast and very far. This pressure is conveyed via the holes 18B into the chamber 21. Since the area S2 of the chamber is greater than the area S1 of the cylinder 17, the resultant of the pressure forces is a force tending to urge the moving assembly in the direction in which it is moving.

This force, and consequently the speed at which the moving assembly is displaced, increases with increasing intensity of the current to be interrupted.

On the first zero crossing of the current, the arc is extinguished by the blast of gas thrust by the piston 9 through the chambers or volumes 17 and 19.

At the end of the circuit breaker opening process, the tube 20 leaves the tube 7, and the nozzle 18 leaves the cylinder 8, thereby opening the chamber 21 to evacuate the gas towards the volume or space 2.

The holes 4B, 5A, and 13B also serve to provide paths for gas evacuation.

Figure 3:
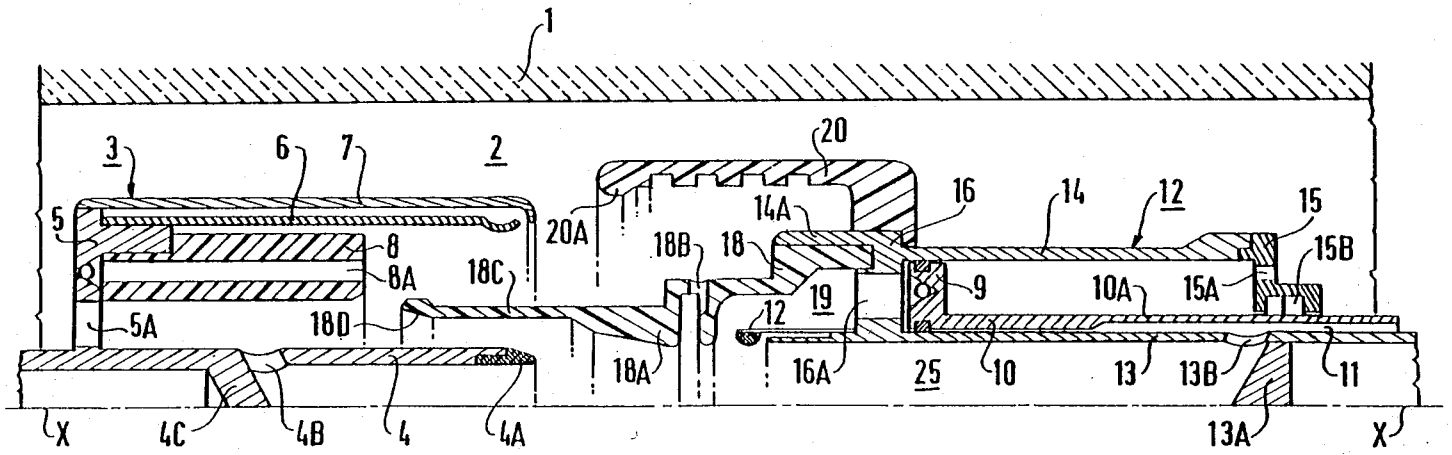
FIG. 3 is a similar view to FIGS. 1 and 2 showing the same circuit breaker in its open position.

The distances between the ends of the tubes 20 and 7 and between the ends of the parts 8 and 18 (in the open position of the circuit breaker as shown in FIG. 3) are chosen in such a manner as to ensure good dielectric behavior between the fixed and moving assemblies.

However, at less than 72 kV, the tube 20 may remain in contact with the tube 7 at the end of a circuit-breaking operation without spoiling proper dielectric behavior of the circuit breaker.

Interrupting low intensity currents (interrupting unloaded or capacitive currents)

The gas compressed by the piston 9 in the volume or chamber 17 is sufficient to extinguish the arc.

I claim:

1. In a compressed gas high tension circuit breaker requiring low operating energy, said circuit breaker comprising a sealed enclosure filled with a gas of high dielectric power, a fixed assembly within said enclosure including a main contact and an arcing contact, and a moving assembly including a main contact and an arcing contact, mounted within said enclosure for movement relative to said fixed assembly, the improvement wherein the moving assembly further includes a chamber, said fixed assembly includes means defining two tubular surfaces and two tubular elements, each of said tubular elements slide over a respective tubular surface of the fixed assembly, and a plurality of holes for placing said chamber into communication with the zone in which the arcing contacts separate.

2. A circuit breaker according to claim 1, wherein a piston is fixed to said fixed assembly, said moving assembly comprises a cylinder engaging said piston fixed to the fixed assembly, one end of the cylinder communicates with the zone in which the arcing contacts separate, and the cross-section of said cylinder being less than the cross-section of said chamber.

3. A circuit breaker according to claim 1, wherein the free volume in said chamber is reduced by a cylinder constituting means defining one of said two tubular surfaces of the fixed assembly.

4. A circuit breaker according to claim 3, wherein said cylinder has a duct passing therethrough, said duct carrying a nonreturn valve for putting the inside and the outside of said chamber into communication with each other.

5. A circuit breaker according to claim 3, wherein one of said tubular elements is a blast nozzle having one end which slides over one of the surfaces of said cylinder.

* * * * *